US007594500B2

(12) United States Patent
Rockwell et al.

(10) Patent No.: US 7,594,500 B2
(45) Date of Patent: Sep. 29, 2009

(54) AIR CONTROL MODULE

(75) Inventors: Jim Rockwell, Bellville, OH (US); Gene Triplett, II, Lewis Center, OH (US)

(73) Assignee: Stoneridge, Inc., Warren, OH (US)

( * ) Notice: Subject to any disclaimer, the term of this patent is extended or adjusted under 35 U.S.C. 154(b) by 0 days.

(21) Appl. No.: 11/624,174

(22) Filed: Jan. 17, 2007

(65) Prior Publication Data

US 2008/0006248 A1 Jan. 10, 2008

Related U.S. Application Data

(60) Provisional application No. 60/759,354, filed on Jan. 17, 2006.

(51) Int. Cl.
*F02M 33/02* (2006.01)

(52) U.S. Cl. ..... 123/519; 123/518

(58) Field of Classification Search ..... 123/198 D, 123/518, 519, 520, 521
See application file for complete search history.

(56) References Cited

U.S. PATENT DOCUMENTS 4,137,882 A * 2/1979 Thornburgh ..... 123/520
4,386,947 A * 6/1983 Mizuno et al. ..... 96/137
4,454,849 A * 6/1984 Mizuno et al. ..... 123/519
5,355,861 A * 10/1994 Arai ..... 123/519
5,450,833 A * 9/1995 Denz et al. ..... 123/520
5,501,198 A * 3/1996 Koyama ..... 123/520
5,562,083 A * 10/1996 Osanai ..... 123/519
5,613,477 A * 3/1997 Maeda ..... 123/519
5,623,911 A * 4/1997 Kiyomiya et al. ..... 123/520
5,632,251 A * 5/1997 Ishikawa ..... 123/519
6,273,070 B1 * 8/2001 Arnal et al. ..... 123/519

* cited by examiner

*Primary Examiner*—Stephen K Cronin
*Assistant Examiner*—J. Page Hufty
(74) *Attorney, Agent, or Firm*—Grossman, Tucker, Perreault & Pfleger, PLLC

(57) ABSTRACT

An air control module comprises a canister purge valve, a vapor blocking valve, a canister vent valve and a housing, wherein at least a portion of the canister purge valve, the vapor blocking valve, and the canister vent valve are disposed within the housing. The housing may optionally include three ports fluidly coupled to the canister purge valve, the vapor blocking valve, and the canister vent valve respectively. The canister purge valve may be fluidly coupled to an atmospheric vent and an evaporation canister (which may be mechanically coupled to the housing of the air control module) for controlling the passage of fuel vapor from the evaporator canister to an engine. The vapor blocking valve may be fluidly coupled to a fuel tank and the evaporation canister, while the canister vent valve may be fluidly coupled to an engine and the evaporation canister. The housing may optionally include an air filter fluidly coupled to the canister vent valve.

20 Claims, 5 Drawing Sheets

AIR CONTROL MODULE

CROSS-REFERENCE TO RELATED APPLICATIONS

This application claims the benefit of U.S. Provisional Application Ser. No. 60/759,354, filed Jan. 17, 2006, which is hereby fully incorporated by reference.

FIELD

The present disclosure generally pertains to evaporative emissions control systems.

BACKGROUND

Conventional motor vehicles, due to increased emission standards, typically include a fuel vapor recovery system. The fuel vapor recovery system includes a vapor or purge canister for receiving fuel vapors generated in the fuel tank. A fuel vapor absorbent, typically activated charcoal, located in the vapor canister retains the fuel vapor when the vapors are displaced from the fuel tank during refilling. During operation of the engine, the fuel vapor contained in the vapor canister is purged by drawing fresh air through the canister and into the intake manifold of the engine.

BRIEF DESCRIPTION OF THE DRAWINGS

Features and advantages of a system and method consistent with the present disclosure are set forth by description of embodiments consistent therewith, which description should be considered in conjunction with the accompanying drawings, wherein.

DETAILED DESCRIPTION

Figure 1:
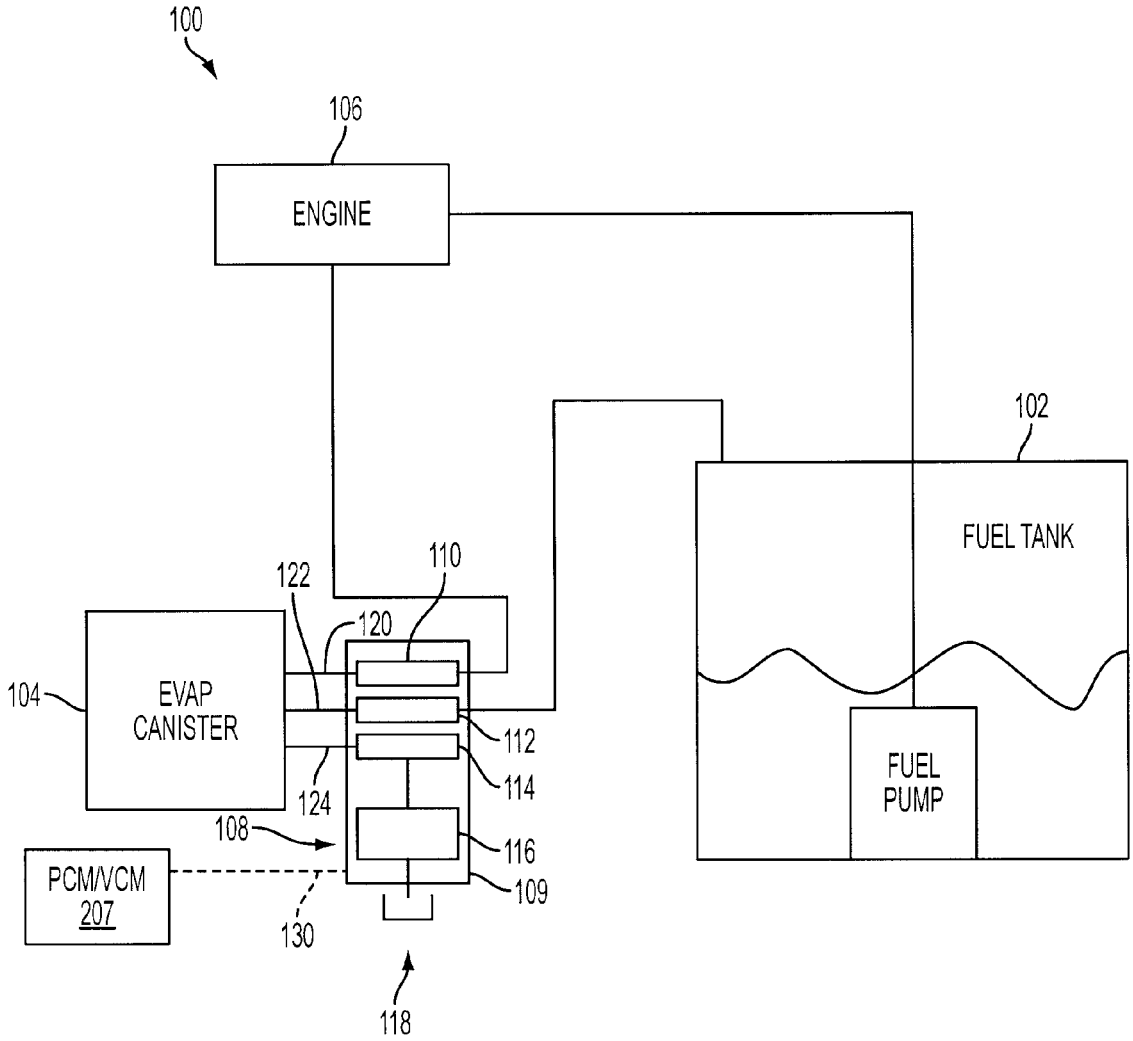
FIG. 1 is a schematic diagram of an embodiment of an evaporative emissions control system consistent with the present disclosure.

Referring to FIG. 1, an embodiment of an evaporative emissions system 100 is schematically illustrated. As shown, the evaporative emissions system 100 may control the release of fuel vapors from the fuel tank 102 during refueling, during elevated temperatures, etc., in which fuel vapors from the fuel tank 102 may be displaced from, e.g. due to being pressurized within, the fuel tank 102 by liquid fuel being delivered to the fuel tank 102.

As shown, fuel vapors from the fuel tank 102 may travel to the evaporative emissions canister 104, which may serve as a storage device for fuel vapors. The evaporative emissions canister 104 may contain a medium, such as activated carbon, which may collect the fuel vapors to prevent the vapor from being emitted into the atmosphere. During normal operation of the vehicle, the fuel vapors collected by the evaporative emissions canister 104 may be released to the engine and may be consumed by the engine 106.

As shown, the evaporative emissions canister 104 may be coupled to the fuel tank 102 and to the engine 106 by an air control module 108. The air control module 108 may include a canister purge valve 110, a vapor blocking valve 112, and a canister vent valve 114 at least partially contained within a housing 109 of the air control module 108. The valves 110, 112 and 114 may take any known valve configuration. In one embodiment, for example, the valves may be solenoid-type valves configured for opening/closing in response to an electrical input. The air control module 108 may also include or may be coupled to an air filter 116 for removing any particulate or liquid, e.g., moisture, contamination from an air intake provided by an atmospheric vent 118.

According to one aspect, the air control module 108 may be provided as a single unit, which may communicate with the evaporative emissions canister 104 via one or more corresponding ports 120, 122, 124. While three ports are shown, a greater or fewer number of ports may be utilized depending upon the exact configuration of the canister 104 and of the various valves 110, 112, 114 of the air control module 108. According to a related aspect, the air control module 108 may be mechanically coupled to the evaporative emissions canister 104 by snap latches. Other fastening arrangements, such as screws, clamps, interacting integral features, etc., may also be suitably employed for coupling the air control module and the evaporative emissions canister. According to yet another aspect, the air control module 108 may include a single connector 130, which may be integral to the air control module 108, for controlling all of the valves 110, 112, 114. The single connector 130 may couple the air control module 108 to an engine control module, or similar control system 207.

The engine control module or similar control system 207 may transmit and/or receive one or more signals to the air control module 108 resulting in the opening and/or closing of the valves 110, 112, 114. The signals may include commands or may include data which may be interpreted by the air control module 108. In either case, the valves 110, 112, 114 may be fully opened/closed or partially opened/closed. Alternatively, one or more of the valves 110, 112, 114 may be provided with an independent connector for controlling the valve.

According to one embodiment, one or more of the valves 110, 112, 114 may be normally open (i.e., the valve 110, 112, and/or 114 may be in an open position unless otherwise instructed to close). In this case, the valve 110, 112, 114 is open unless the engine control module, or similar control system 207 instructs the valve 110, 112, 114 to close. For example, the valve 110, 112, 114 may be fail-safe open. According to another embodiment, one or more of the valves 110, 112, 114 may be normally closed (i.e., the valve 110, 112, and/or 114 may be in a closed position unless otherwise instructed to open). In this case, the valve 110, 112, 114 is closed unless the engine control module, or similar control system 207 instructs the valve 110, 112, 114 to open. For example, the valve 110, 112, and/or 114 may be fail-safe closed. Alternatively, one or more of the valves 110, 112, 114 may not be biased towards either the open or closed position.

Figure 2:
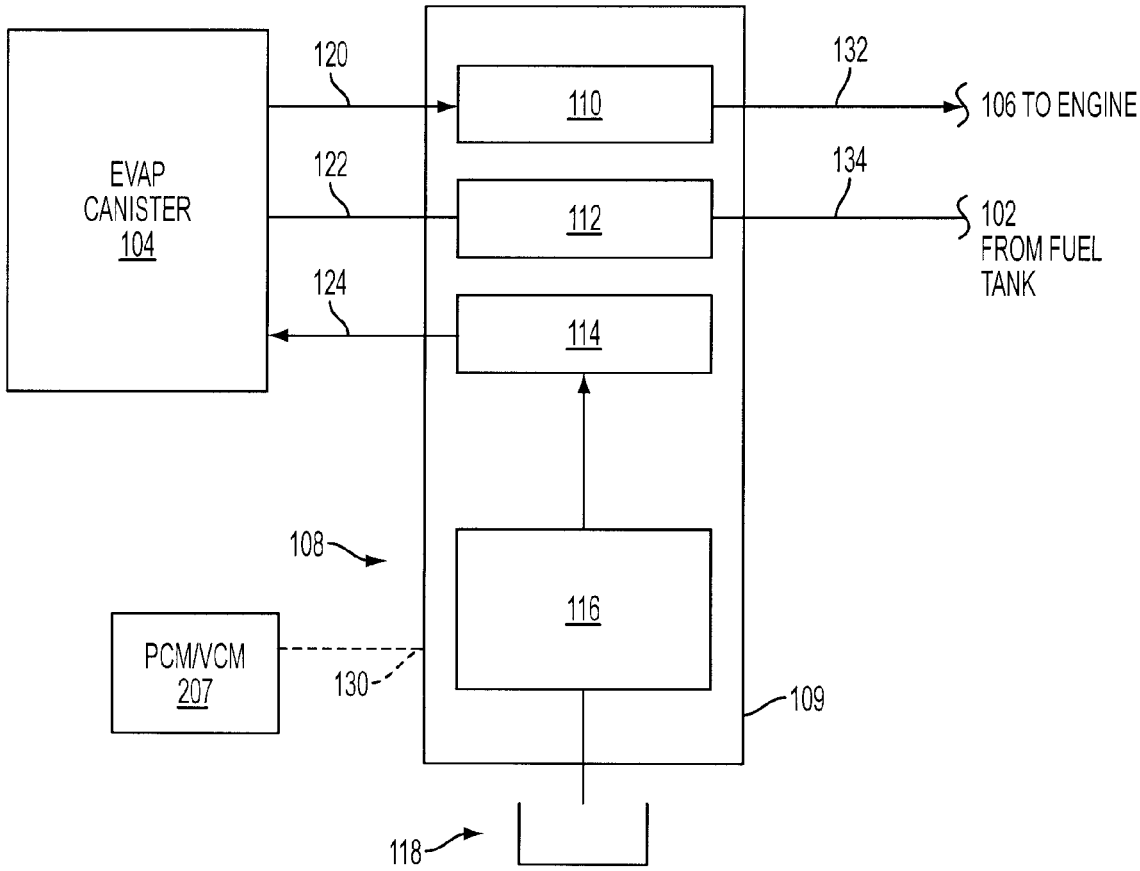
FIG. 2 is a schematic diagram of an embodiment of an evaporative emissions control system consistent with the present disclosure during normal engine operation.

The canister purge valve 110 of the air control module 108 may control the passage of fuel vapor from the evaporative emissions canister 104 through the port 120 to the engine 106 through a port 132 in the housing 109 of the air control module 108. For example, during normal engine operating conditions as shown in FIG. 2, the fuel vapors stored in the evaporative emissions canister 104 may be provided to the engine 106. The engine control module, or similar control system 207 may transmit a signal to the air control module 108 resulting in the canister purge valve 110 opening during normal operating conditions to allow the passage of fuel vapor from the evaporative emissions canister 104 to the engine 106. Vacuum from the intake manifold may draw the fuel vapor from the evaporative emissions canister 104 to the engine 106, where the fuel vapor may mix with air in the intake manifold to be consumed by the engine 106.

The canister vent valve 114 may be normally open to allow the flow of air into the evaporative emissions canister 104 through the atmospheric vent 118. During normal engine operating conditions as shown in FIG. 2, the engine control module, or similar control system 207 may additionally transmit a signal to the air control module 108 resulting in the canister vent valve 114 opening. As a result, air drawn into the evaporative emissions canister 104 may flow through the canister medium and canister purge valve 110 (when it is open) allowing the fuel vapor stored in the evaporative emissions canister 104 to be delivered to the engine 106. The air filter 116 may remove at least a portion of any particulate, liquid, e.g., moisture, etc., contamination in the air passing from the atmospheric vent 118, through the canister vent valve 114, and into the evaporative emissions canister 104.

Figure 3:
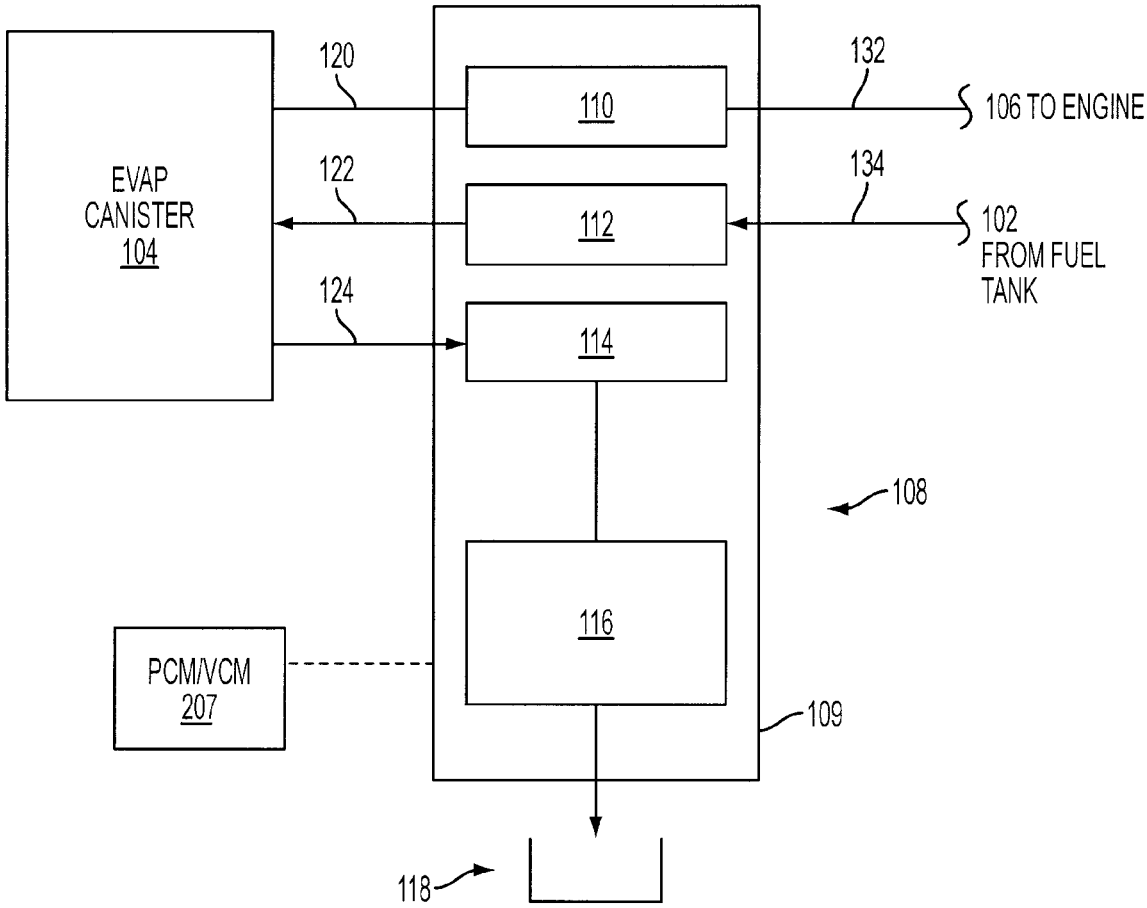
FIG. 3 is a schematic diagram of another embodiment of an evaporative emissions control system consistent with the present disclosure.

In addition to controlling air flow into the evaporative emissions canister 104 during normal engine operating conditions, the canister vent valve 114 may control the flow of air from the evaporative emissions canister 104. For example, during fueling or elevated temperatures as shown in FIG. 3, fuel vapor may flow from the fuel tank 102 and into the evaporative emissions canister 104, as a result of the increased pressure within the fuel tank 102. After at least a portion of fuel vapor has been extracted by the canister medium, the air may flow from the evaporative emissions canister 104 and out through the canister vent valve 114, allowing the pressure in the fuel tank 102 to be reduced. The canister vent valve 114 may be closed during diagnostic testing of the evaporative emissions system 100, etc.

The vapor blocking valve 112 may be disposed between the fuel tank 102 and the evaporative emissions canister 104. The vapor blocking valve 112 may control the flow of vapors, through a port 134 in the housing 109 of the air control module 108, between the fuel tank 102 and the remainder of the evaporative emissions system 100. For example, the vapor blocking valve 112 may allow fuel vapor to travel from the fuel tank to the evaporative emissions canister 104, e.g., as a result of an increase in pressure within the fuel tank, e.g., during refueling or during elevated temperatures as shown in FIG. 3. The vapor blocking valve 112 may, however prevent the flow of fuel vapor from the fuel tank 102 and to the engine 106 as a result of intake manifold vacuum, which would normally draw fuel vapor from the evaporative emissions canister 104 through the canister purge valve 110 as shown in FIG. 2. For example, the vapor blocking valve 112 may be controlled to be closed when the canister vent valve 110 is open. It should be appreciated, however that various additional and/or alternative control schemes may suitably be employed herein.

Figure 4:
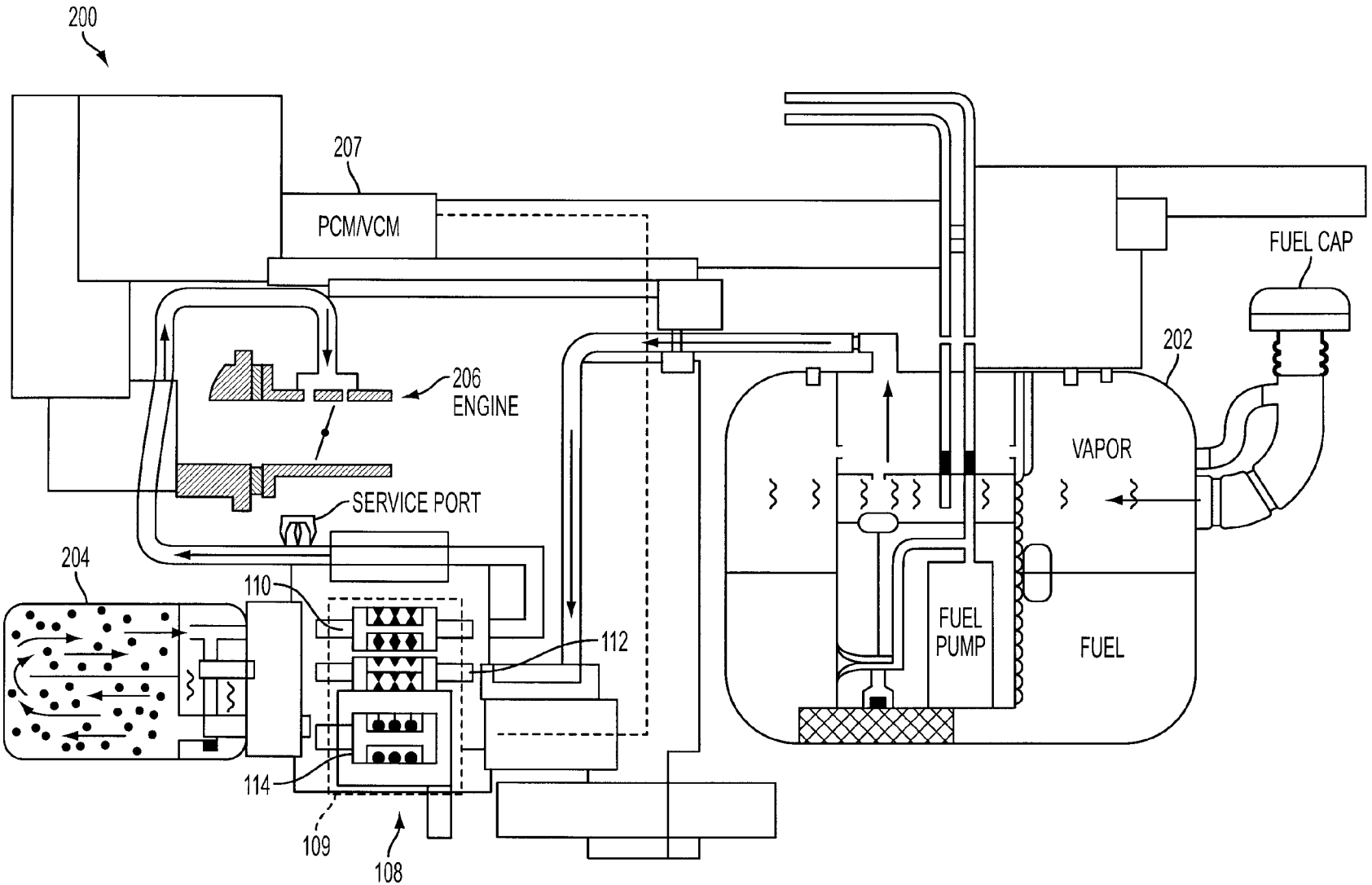
FIG. 4 is a schematic diagram of an embodiment of an evaporative emissions control system consistent with the present disclosure while the engine is not operating.

Referring to FIG. 4, another embodiment of an evaporative emissions system 200 is shown. As illustrated, the evaporative emissions system 200 may include an air control module 108 for controlling the flow of fuel vapor from a fuel tank 202 into an evaporative emissions canister 204 and from the evaporative emissions canister 204 to an engine 206, e.g., to an intake manifold. Additionally, the air control module 108 may control the flow of air into and out of the evaporative emissions canister 204. The air control module 108 may include a plurality of valves for controlling the flow of fuel vapor and air through the evaporative emissions canister 204. For example, the air control module may include a canister vent valve 114, a vapor blocking valve 112, and a purge valve 110. The valves of the air control module 108 may be controlled by an engine management controller 207, and may be coupled to the engine management controller 207 via a single integral connector on the air control module 108. The air control module 108 may also include a fresh air filter for removing at least a portion of any particulate or liquid contaminants from air admitted into the evaporative emissions canister 204. The air control module 108 may communicate with the evaporative emissions canister 204 through connecting ports, and may be mechanically coupled to the evaporative emissions canister 204 by snap latches.

Figure 5:
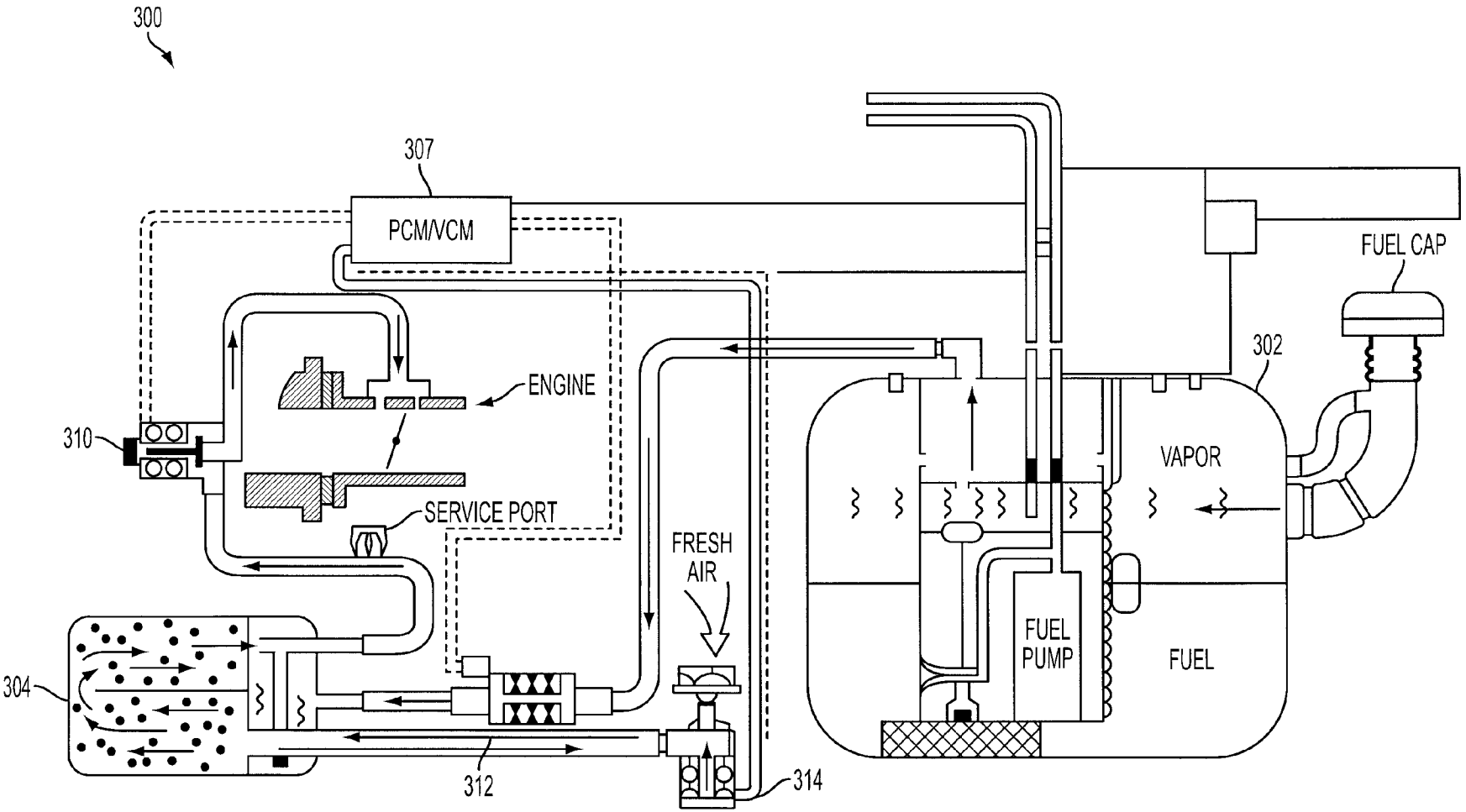
FIG. 5 is a schematic diagram of another embodiment of an evaporative emissions control system consistent with the present disclosure.

Turning to FIG. 5, yet another embodiment of an evaporative emissions control system 300 is depicted. Similar to the preceding embodiments, the evaporative emissions control system 300 may include an evaporative emissions canister 304 for collecting fuel vapor from a fuel tank 302. A vapor isolation valve 312 may be provided between the fuel tank 302 and the evaporative emissions canister 304 for controlling the flow of fuel vapor from the fuel tank 302 to the evaporative emissions canister 304. The vapor isolation valve 312 may also prevent fuel vapor from being drawn from the fuel tank 302 and through the evaporative emissions canister 304 by the vacuum of the intake manifold when the canister purge valve 310 is open. As with previous embodiments, the canister purge valve 310 may allow fuel vapor collected by the evaporative emissions canister 304 to be drawn in to the engine, as by the vacuum of the intake manifold. Additionally the system 300 may include a canister vent valve 314 for controlling the flow of air into and out of the evaporative emissions canister 304.

According to one aspect of the present disclosure, there is thus provided an air control module including: a canister purge valve; a vapor blocking valve; a canister vent valve; and a housing, wherein at least a portion of the canister purge valve, the vapor blocking valve, and the canister vent valve are disposed within the housing.

According to another aspect of the disclosure there is provided an evaporative emission system including: a fuel tank; an engine; an evaporation canister; and air control module including: a canister vent valve fluidly coupled to an atmospheric vent and the evaporation canister; a vapor blocking valve fluidly coupled to the fuel tank and the evaporation canister; a canister vent valve fluidly coupled to the engine and the evaporation canister; and a housing, wherein at least a portion of the canister purge valve, the vapor blocking valve, and the canister vent valve are disposed within the housing.

According to yet another aspect of the disclosure there is provided a method of fabricating an evaporative emission system including: providing an air control module including a canister purge valve, a vapor blocking valve, a canister vent valve, and a housing, wherein at least a portion of the canister purge valve, the vapor blocking valve, and the canister vent valve are disposed within the housing; fluidly coupling the canister vent valve to an atmospheric vent and an evaporation canister; fluidly coupling the vapor blocking valve to a fuel tank and the evaporation canister; and fluidly coupling the canister purge valve to an engine and the evaporation canister.

The various features and aspects of the illustrated embodiments of a filter system herein are set forth for the purpose of illustration, and not of limitation. Such features and aspects are susceptible to combination with the features and aspects of the various other embodiments herein. Furthermore, the embodiment described and illustrated are susceptible to variation and modification without departing from the present claims.

What is claimed is:

1. An air control module comprising:

a canister purge valve;

a vapor blocking valve;

a canister vent valve;

a housing, wherein at least a portion of said canister purge valve, said vapor blocking valve, and said canister vent valve are disposed within said housing; and at least one fastener configured couple said housing to an evaporation canister, said at least one fastener selected from the group consisting of snap latches, screws, clamps or interacting integral features.

2. The air control module of claim 1 wherein said housing further comprises a canister purge valve port, a vapor blocking valve port, and a canister vent valve port fluidly coupled to said canister purge valve, said vapor blocking valve, and said canister vent valve, respectively.

3. The air control module of claim 2 wherein said canister vent valve is fluidly coupled to an air filter.

4. The air control module of claim 3 wherein said air filter is at least partially disposed within said housing.

5. The air control module of claim 2 wherein said canister vent valve port, said vapor blocking valve port and said canister purge valve port are fluidly coupled to said evaporation canister.

6. The air control module of claim 1 wherein said housing further comprises at least one connector, said at least one connector configured to receive at least one signal from an engine control module for controlling an operation of at least one of said canister purge valve, said vapor blocking valve, and said canister vent valve.

7. The air control module of claim 6 further comprising a single connector integrally coupled to said housing, said signal connector configured to receive said at least one signal from said engine control module for controlling said operation of at least one of said canister purge valve, said vapor blocking valve, and said canister vent valve.

8. The air control module of claim 1 wherein said housing is mechanically coupled to said evaporation canister.

9. The air control module of claim 8 wherein said housing is mechanically coupled to said evaporation canister by at least one snap latch.

10. An evaporative emission system comprising:

a fuel tank;

an engine;

an evaporation canister;

air control comprising:

a canister vent valve fluidly coupled to an atmospheric vent and said evaporation canister;

a vapor blocking valve fluidly coupled to said fuel tank and said evaporation canister;

a canister purge valve fluidly coupled to said engine and said evaporation canister; and a housing, wherein at least a portion of said canister purge valve, said vapor blocking valve, and said canister vent valve are disposed within said housing; and at least one fastener configured couple said housing to said evaporation canister, said at least one fastener selected from the group consisting of snap latches, screws, clamps or interacting integral features.

11. The evaporative emission system of claim 10 wherein said canister purge valve is open and said vapor blocking valve is closed while said engine is operating.

12. The evaporative emission system of claim 11 wherein said canister vent valve is open while said engine is operating, wherein air flows through said atmospheric vent and said canister vent valve and into said evaporation canister.

13. The evaporative emission system of claim 10 wherein said canister purge valve is closed and said vapor blocking valve is open while said engine is not operating.

14. The evaporative emission system of claim 13 wherein said canister vent valve is open while said engine is not operating, wherein air flows from said gas tank, though said vapor blocking valve and said evaporation canister and through said canister vent valve to said atmospheric vent.

15. The evaporative emission system of claim 10 wherein said housing is mechanically coupled to said evaporation canister with a plurality of snap latches.

16. The evaporative emission system of claim 10 wherein said housing further comprises a canister purge valve port fluidly coupled to said canister purge valve and said evaporation canister, a vapor blocking valve port fluidly coupled to said vapor blocking valve and said evaporation canister, and a canister vent valve port fluidly coupled to said canister vent valve and said evaporation canister.

17. A method of fabricating an evaporative emission system comprising:

providing an air control module comprising a canister purge valve, a vapor blocking valve, a canister vent valve, and a housing, wherein at least a portion of said canister purge valve, said vapor blocking valve, and said canister vent valve are disposed within said housing;

mechanically coupling said housing to said evaporation canister using at least one fastener, said at least one fastener selected from the group consisting of snap latches, screws, clamps or interacting integral features;

fluidly coupling said canister vent valve to an atmospheric vent and said evaporation canister;

fluidly coupling said vapor blocking valve to a fuel tank and said evaporation canister; and fluidly coupling said canister purge valve to an engine and said evaporation canister.

18. The method of claim 17 further comprising transmitting a signal from an engine control module to said air control module, wherein said signal controls an operation of at least one of said canister purge valve, said vapor blocking valve, and said canister vent valve.

19. The method of claim 18 further comprising fluidly coupling an air filter between said canister vent valve and said atmospheric vent.

20. The method of claim 17 further comprising opening said canister purge valve and closing said vapor blocking valve while said engine is operating and closing said canister purge valve and opening said vapor blocking valve while said engine is not operating.

* * * * *